US009816747B2

(12) United States Patent
An et al.

(10) Patent No.: US 9,816,747 B2
(45) Date of Patent: Nov. 14, 2017

(54) REFRIGERATOR AND MANUFACTURING METHOD THEREOF

(71) Applicant: SAMSUNG ELECTRONICS CO., LTD., Suwon (KR)

(72) Inventors: Jae Koog An, Gwangju (KR); Jeong Hun Shin, Siheung (KR); Byung Su Kim, Daejeon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 320 days.

(21) Appl. No.: 13/859,447

(22) Filed: Apr. 9, 2013

(65) Prior Publication Data

US 2013/0263620 A1 Oct. 10, 2013

(30) Foreign Application Priority Data

Apr. 10, 2012 (KR) ..... 10-2012-0037206

(51) Int. Cl.
*F25C 5/18* (2006.01)
*F25D 23/06* (2006.01)
(Continued)

(52) U.S. Cl.
CPC ..... *F25D 23/066* (2013.01); *F25C 5/18* (2013.01); *F25D 23/064* (2013.01); *F25C 5/005* (2013.01); *F25C 5/007* (2013.01); *F25C 5/182* (2013.01); *F25C 2400/10* (2013.01); *F25D 23/065* (2013.01); *F25D 23/12* (2013.01); *F25D 2201/126* (2013.01)

(58) Field of Classification Search
CPC .. F25C 5/007; F25C 5/18; F25C 5/182; F25C 5/005; F25D 23/066; F25D 23/065
USPC ..... 62/340, 411, 341, 342, 344; 220/592.02
See application file for complete search history.

(56) References Cited

U.S. PATENT DOCUMENTS 3,601,463 A * 8/1971 Watt ..... 312/406
4,006,947 A * 2/1977 Haag ..... B65D 81/3823 220/592.1
(Continued)

FOREIGN PATENT DOCUMENTS

CN 102116564 A 7/2011
KR 10-2006-0074931 7/2006
(Continued)

OTHER PUBLICATIONS

International Search Report dated Jun. 25, 2013 in corresponding International Patent Application PCT/KR2013/002898.
(Continued)

*Primary Examiner* — David Teitelbaum
(74) *Attorney, Agent, or Firm* — Staas & Halsey LLP

(57) ABSTRACT

A refrigerator in which an ice making chamber case including a horizontal wall, a vertical wall, a front opening and a front edge is coupled to an inside of an inner case, to form an ice making chamber. A case insulator is disposed in a wall space of the ice making chamber case. The case insulator is foamed separately from a body insulator which is foamed between inner and outer cases of a refrigerator body. Since the case insulator is foamed separately from the body insulator, it is possible to easily achieve foaming of the case insulator. It is also possible to prepare the ice making chamber case separately from molding of the inner case.

14 Claims, 11 Drawing Sheets

(51) Int. Cl.
*F25C 5/00* (2006.01)
*F25D 23/12* (2006.01)

(56) References Cited

U.S. PATENT DOCUMENTS

| | | | | |
|---|---|---|---|---|
| 4,722,199 | A * | 2/1988 | Hibino | 62/344 |
| 4,771,532 | A | 9/1988 | Taylor et al. | |
| 5,749,241 | A * | 5/1998 | Ryu et al. | 62/340 |
| 7,337,620 | B2 | 3/2008 | Coulter et al. | |
| 2005/0210909 | A1 | 9/2005 | Kim et al. | |
| 2006/0090496 | A1 | 5/2006 | Adamski et al. | |
| 2006/0260350 | A1 | 11/2006 | Van Meter et al. | |
| 2007/0152551 | A1 | 7/2007 | Kim et al. | |
| 2007/0228236 | A1* | 10/2007 | MacKay et al. | 248/205.3 |
| 2008/0104977 | A1 | 5/2008 | Coulter et al. | |
| 2008/0134708 | A1* | 6/2008 | Lee et al. | 62/340 |
| 2009/0064703 | A1 | 3/2009 | Kim | |
| 2010/0050681 | A1* | 3/2010 | Ryu et al. | 62/344 |
| 2010/0101260 | A1* | 4/2010 | Lee et al. | 62/344 |
| 2011/0162406 | A1 | 7/2011 | Shin | |
| 2011/0302950 | A1* | 12/2011 | Hawkins et al. | 62/344 |
| 2012/0000234 | A1 | 1/2012 | Adamski et al. | |
| 2012/0121322 | A1 | 5/2012 | Minelli | |

FOREIGN PATENT DOCUMENTS

| | | |
|---|---|---|
| KR | 10-2009-0013573 | 2/2009 |
| KR | 10-2011-0047591 | 5/2011 |
| WO | 99/20964 | 4/1999 |

OTHER PUBLICATIONS

U.S. Restriction Requirement dated Aug. 1, 2014 in related U.S. Appl. No. 13/947,558.
U.S. Office Action dated Mar. 12, 2015 in related U.S. Appl. No. 13/947,558.
Chinese Office Action dated May 5, 2016 in corresponding Chinese Patent Application No. 201310123215.8.
U.S. Office Action dated May 18, 2016 in related U.S. Appl. No. 13/947,558.
Chinese Office Action dated Dec. 22, 2016 in corresponding Chinese Patent Application No. 201310123215.8.
U.S. Office Action dated Nov. 7, 2016 in related U.S. Appl. No. 13/947,558.
European Search Report dated Oct. 27, 2015 issued in corresponding European Patent Application 13163192.1.
U.S. Office Action dated Dec. 8, 2015 in co-pending U.S. Appl. No. 13/947,558.
Interview Summary dated Oct. 27, 2015 in co-pending U.S. Appl. No. 13/947,558.
Office Action dated Mar. 12, 2015 in co-pending U.S. Appl. No. 13/947,558.
Final Office Action dated Apr. 5, 2017 in co-pending U.S. Appl. No. 13/947,558.
Office Action dated Aug. 20, 2015 in co-pending U.S. Appl. No. 13/947,558.
European Office Action dated Mar. 31, 2017 in European Patent Application No. 13 163 192.1.

* cited by examiner

REFRIGERATOR AND MANUFACTURING METHOD THEREOF

CROSS-REFERENCE TO RELATED APPLICATIONS

This application claims the priority benefit of Korean Patent Application No. 10-2012-0037206 filed on Apr. 10, 2012 in the Korean Intellectual Property Office, the disclosure of which is incorporated herein by reference.

BACKGROUND

1. Field

Embodiments of the present disclosure relate to a refrigerator with an ice making chamber.

2. Description of the Related Art

Generally, a refrigerator is a home appliance including a storage chamber to store food, and a cold air supplier to supply cold air to the storage chamber in order to keep food fresh. To satisfy consumer demand, such a refrigerator may be provided with an ice making chamber and an ice maker, for production of ice.

Such an ice making chamber is provided separately from refrigerating and freezing compartments. In particular, in a bottom mounted freezer (BMF) type refrigerator, in which a refrigerating compartment is formed at an upper portion of the refrigerator, and a freezing compartment is formed at a lower portion of the refrigerator, or in a French door refrigerator (FDR) type refrigerator, the ice making chamber may be arranged at one portion of an upper portion of the refrigerating compartment.

Therefore, it may be necessary to provide an insulation wall to prevent heat exchange between the refrigerating compartment and the ice making chamber. Conventionally, upon foaming an insulator material in a space between inner and outer cases of a refrigerator body, the insulator material is also foamed in an inner wall space of the insulation wall.

One example of such a refrigerator is disclosed in U.S. Pat. No. 7,337,620. In this refrigerator, the insulation wall of the ice making chamber includes an inner case of the ice making chamber, an outer case of the ice making chamber, and an insulator interposed between the inner and outer cases.

In this case, the outer case of the ice making chamber is integrated with the inner case of the refrigerator body. The insulator is foamed between the inner and outer cases of the ice making chamber, simultaneously with foaming of the insulator between the inner and outer cases of the refrigerator body.

SUMMARY

Therefore, it is an aspect of the present disclosure to provide an ice making chamber assembly structure capable of simplifying an inner case structure of a refrigerator body and simplifying manufacture thereof.

It is another aspect of the present disclosure to provide an ice making chamber assembly structure capable of enabling separation of an ice making chamber case to define an ice making chamber from a refrigerator body, thereby achieving easy replacement and repair of components installed in the ice making chamber.

Additional aspects of the disclosure will be set forth in part in the description which follows and, in part, will be apparent from the description, or may be learned by practice of the disclosure.

In accordance with one aspect of the present disclosure, a refrigerator includes an inner case including a storage compartment formed in an interior of the inner case, the storage compartment being partitioned into an upper refrigerating compartment and a lower freezing compartment, an outer case coupled to an outside of the inner case, a body insulator interposed between the inner case and the outer case, and an ice making chamber case coupled to an inside of the inner case in the refrigerating compartment, the ice making chamber case forming an ice making chamber together with at least a portion of the inner case, wherein the ice making chamber case includes a first ice making chamber case having an integrated structure including a first horizontal wall and a first vertical wall, a second ice making chamber case coupled to an outside of the first ice making chamber case, the second ice making chamber case including a second horizontal wall and a second vertical wall, and a case insulator interposed between the first ice making chamber case and the second ice making chamber case, to insulate the ice making chamber from the refrigerating compartment, the case insulator being separate from the body insulator.

The inner case may further include a top wall, opposite side walls, a rear wall, a bottom wall, and an intermediate wall. The ice making chamber may be formed by at least a portion of the top wall, at least a portion of one of the side walls, at least a portion of the rear wall, the first horizontal wall and the first vertical wall.

The ice making chamber case may further include a front opening, and a front edge formed along an outside of the front opening. The front edge may include the case insulator.

The inner case may further include one or more engagement holes and one or more first fastening holes. The ice making chamber case may further include one or more engagement protrusions respectively formed at positions corresponding to the engagement holes, and one or more second fastening holes formed at positions corresponding to the first fastening holes. The engagement protrusions may be engaged in the engagement holes, respectively. Fastening members may be fastened into corresponding ones of the first and second fastening holes, respectively.

The inner case may further include grooves to receive ends of the ice making chamber case.

The refrigerator may further include a sealing member interposed between the inner case and the ice making chamber case, to seal the ice making chamber case from the inner case.

The sealing member may include a sponge.

The refrigerator may further include a reinforcing member coupled to the outside of the inner case.

In accordance with another aspect of the present disclosure, a refrigerator includes an inner case including a top wall, oppositeside walls, a rear wall and a bottom wall, an outer case coupled to an outside of the inner case, a body insulator interposed between the inner case and the outer case, an ice making chamber case coupled to an inside of the inner case, to form an ice making chamber, the ice making chamber case including a horizontal wall, a vertical wall, a front opening and a front edge formed along an outside of the front opening, and an ice bucket slidable into the ice making chamber through the front opening, wherein the front edge includes a first edge contacting the top wall, a second edge to form at least a portion of the vertical wall, a third edge to form at least a portion of the horizontal wall, and a fourth edge contacting one of the side walls.

The ice bucket may include a gasket to seal the ice making chamber. The front edge may further include an outer surface, and a gasket contact portion extending inwardly from the outer surface, to enable the gasket to contact the gasket contact portion. The gasket contact portion may include a first surface inwardly inclined from the outer surface, and a second surface inclined from the first surface such that a step is formed between the outer surface and the second surface. The gasket may contact the first and second surfaces in a dual surface contact manner.

Each of the horizontal wall, the vertical wall, and the front edge may include a case insulator.

In accordance with another aspect of the present disclosure, a refrigerator includes an inner case including a top wall, opposite side walls, a rear wall and a bottom wall, an outer case coupled to an outside of the inner case, a body insulator interposed between the inner case and the outer case, an ice making chamber case including a horizontal wall and a vertical wall, the ice making chamber case being coupled to an inside of the inner case such that the horizontal and vertical walls form an ice making chamber together with at least a portion of the top wall, at least a portion of one of the side walls and at least a portion of the rear wall, wherein the inner case further includes one or more engagement holes and one or more first fastening holes, wherein the ice making chamber case further includes one or more engagement protrusions respectively formed at positions corresponding to the engagement holes, and one or more second fastening holes formed at positions corresponding to the first fastening holes, wherein the engagement protrusions are engaged in the engagement holes, respectively, and wherein fastening members are fastened into corresponding ones of the first and second fastening holes, respectively.

Each of the fastening members may include a fastening portion to be fastened into the corresponding first and second fastening holes, and a head formed at one end of the fastening portion. The head may be disposed between the inner case and the outer case while being coved by the body insulator.

Each of the fastening members may include a fastening portion to be fastened into the corresponding first and second fastening holes, and a head formed at one end of the fastening portion. The head may be disposed at the inside of the inner case.

The ice making chamber case may further include one or more fitting protrusions protruded from each of the horizontal and vertical walls. The one or more second fitting holes may be formed at the one or more fitting protrusions, respectively.

The refrigerator may further include a reinforcing member coupled to the outside of the inner case. The reinforcing member may include one or more third fitting holes respectively formed at positions corresponding to corresponding ones of the first and second fastening holes. Each of the fastening members may be fastened into corresponding ones of the first, second and third fastening holes.

In accordance with another aspect of the present disclosure, a method of manufacturing a refrigerator includes preparing an inner case including a top wall, opposite side walls, a rear wall and a bottom wall, preparing an outer case to be coupled to an outside of the inner case, preparing an ice making chamber case including a horizontal wall, a vertical wall and a case insulator interposed between a case insulator, the horizontal and vertical walls forming an ice making chamber together with at least a portion of the top wall, at least a portion of one of the side walls and at least a portion of the rear wall, coupling the ice making chamber case to an inside of the inner case, coupling the outer case to the outside of the inner case, and foaming a body insulator between the inner case and the outer case.

The preparing the ice making chamber case may include preparing a first ice making chamber case, preparing a second ice making chamber case to be coupled to an outside of the first ice making chamber, preparing the case insulator to be interposed between the first ice making chamber case and the second ice making chamber case, and coupling the first ice making chamber case, the case insulator, and the second ice making chamber case.

The preparing the ice making chamber case may include preparing a first ice making chamber case, preparing a second ice making chamber case to be coupled to an outside of the first ice making chamber, coupling the first ice making chamber case and the second ice making chamber case, and foaming the case insulator between the first ice making chamber case and the second ice making chamber case.

In accordance with another aspect of the present disclosure, a method of manufacturing a refrigerator includes preparing an inner case including a top wall, opposite side walls, a rear wall, a bottom wall, one or more engagement holes and one or more first fastening holes, preparing an outer case to be coupled to an outside of the inner case, preparing an ice making chamber case including a horizontal wall, a vertical wall, one or more engagement protrusions and one or more second fastening holes, the horizontal and vertical walls forming an ice making chamber together with at least a portion of the top wall, at least a portion of one of the side walls and at least a portion of the rear wall, engaging the engagement protrusions in the engagement holes, subsequently fastening fastening members into corresponding ones of the first and second fastening holes, respectively, subsequently coupling the outer case to the outside of the inner case, and subsequently foaming a body insulator between the inner case and the outer case.

The fastening the fastening members into the corresponding first and second fastening holes may include fastening the fastening members in an inward direction from the outside of the inner case.

In accordance with still another aspect of the present disclosure, a method of manufacturing a refrigerator includes preparing an inner case including a top wall, opposite side walls, a rear wall, a bottom wall, one or more engagement holes and one or more first fastening holes, preparing an outer case to be coupled to an outside of the inner case, preparing an ice making chamber case including a horizontal wall, a vertical wall, one or more engagement protrusions and one or more second fastening holes, the horizontal and vertical walls forming an ice making chamber together with at least a portion of the top wall, at least a portion of one of the side walls and at least a portion of the rear wall, engaging the engagement protrusions in the engagement holes, subsequently coupling the outer case to the outside of the inner case, subsequently foaming a body insulator between the inner case and the outer case, and subsequently fastening fastening members into corresponding ones of the first and second fastening holes, respectively.

The fastening the fastening members into the corresponding first and second fastening holes may include fastening the fastening members in an outward direction from an inside of the inner case.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Hereinafter, embodiments of the present disclosure will be described with reference to the accompanying drawings.

Figure 1:
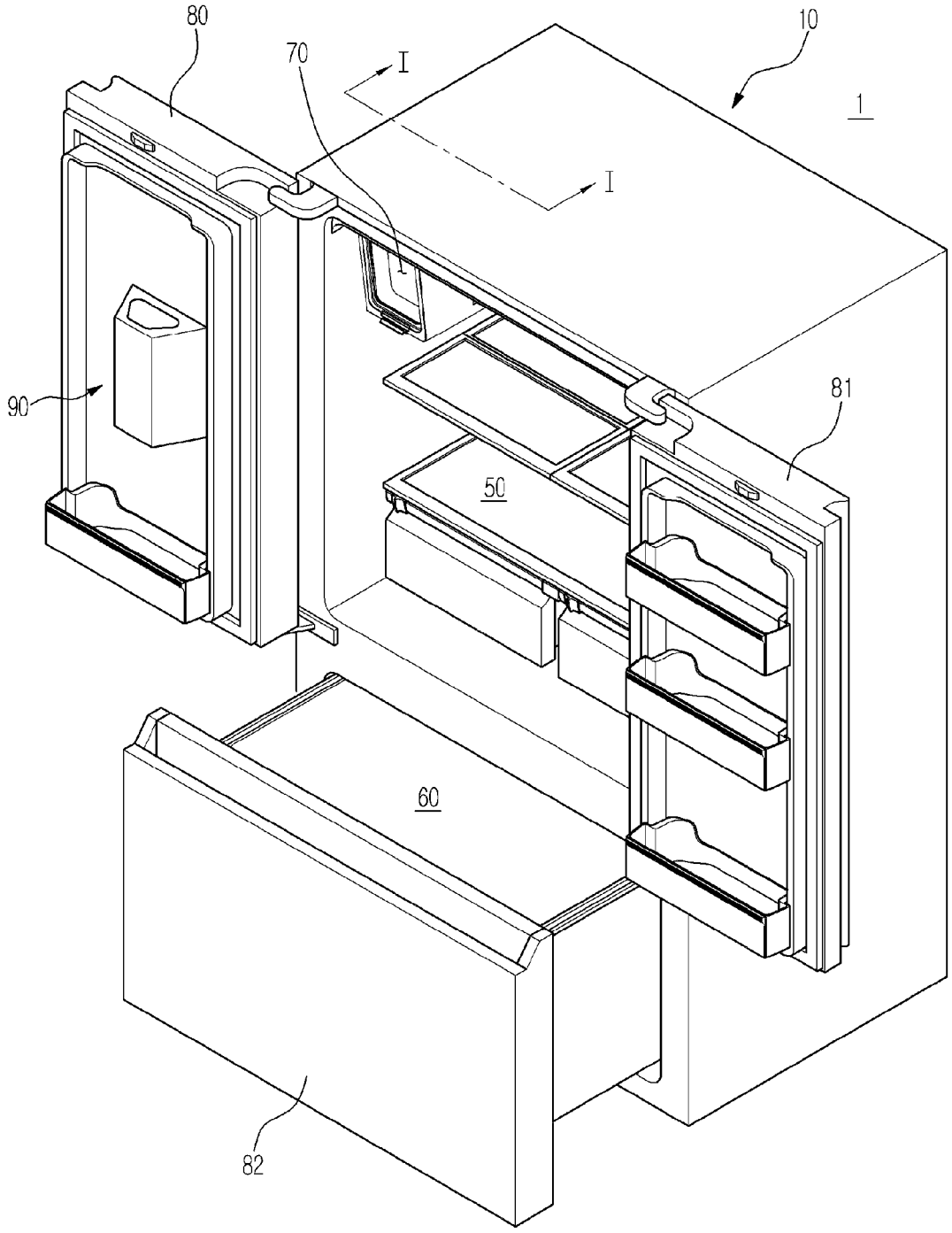
FIG. 1 is a perspective view illustrating a refrigerator according to an embodiment of the present disclosure.
Figure 2:
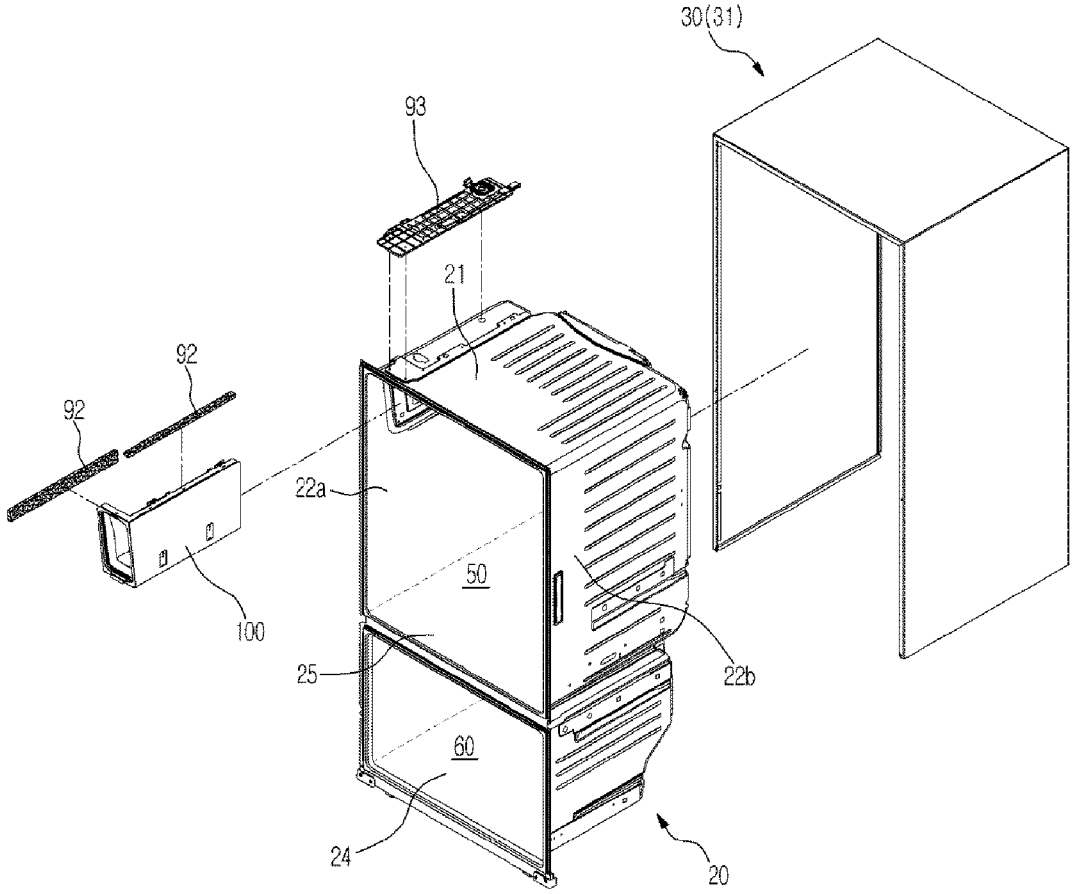
FIG. 2 is an exploded perspective view illustrating a main configuration of the refrigerator shown in FIG. 1.

FIG. 1 is a perspective view illustrating a refrigerator according to an embodiment of the present disclosure. FIG. 2 is an exploded perspective view illustrating a main configuration of the refrigerator shown in FIG. 1.

Referring to FIGS. 1 and 2, the refrigerator 1 includes a body 10, storage compartments 50 and 60 formed in the body 10, to store food, and a cold air supplier (not shown) to supply cold air to the storage compartments 50 and 60.

The body 10 includes an inner case 20 to form the storage compartments 50 and 60, an outer case 30 coupled to the outside of the inner case 20, to form an appearance of the refrigerator 1, and an insulator 40 (FIG. 5) foamed between the inner case 20 and the outer case 30. In order to distinguish the insulator 40 foamed between the inner and outer cases 20 and 30 of the body 10 from an insulator 130 (FIG. 5) foamed in the inside of an ice making chamber case 100, the former insulator will be referred to as a "body insulator 40", and the latter insulator will be referred to as a "case insulator 130".

The inner case 20 includes a top wall 21, opposite side walls 22*a* and 22*b*, a rear wall 23, a bottom wall 24, and an intermediate wall 25. The inner case 20 may be injection-molded using a plastic material such that it has an integrated structure. The intermediate wall 25 of the inner case 20 may partition the storage compartments 50 and 60 into an upper refrigerating compartment 50 and a lower freezing compartment 60. An opening 29 (FIG. 4) may be formed through the rear wall 23 of the inner case 20, in order to allow a direct cooling pipe 210 (FIG. 4) to be inserted into an ice making chamber 70. Although as a non-limiting example, the storage compartments are partitioned into the upper refrigerating compartment and the lower freezing compartment, the storage compartments may be partitioned into an upper/lower freezing compartment and a lower/upper refrigerating compartment, partitioned into a left/right refrigerating compartment and a right/left refrigerating compartment, or partitioned into any combination of the upper, lower, left and right refrigerating/freezing compartments.

The outer case 30 may include a main frame 31 disposed at top and opposite sides of the inner case 20, a back frame (not shown) disposed at the back portion of the inner case 20, and a bottom frame (not shown) disposed at the bottom portion of the inner case 20. The outer case 30 may be made of a material such as metal so that it has durability and esthetics.

The body insulator 40 may be formed by coupling the inner and outer cases 20 and 30, filling a space between the coupled inner and outer cases 20 and 30 with a foaming agent such as urethane, and expanding the foaming agent.

The refrigerating compartment 50 and freezing compartment 60 may be opened at front sides thereof, respectively. The front sides of the refrigerating and freezing compartments 50 and 60 may be opened or closed by doors 80, 81 and 82. That is, the refrigerating compartment 50 may be opened or closed by a plurality of hinge doors 80 and 81 pivotally mounted to the body 10. The freezing compartment 60 may be opened or closed by a sliding door 82 which is slidable along the freezing compartment 60.

A dispenser 90 may be provided at least one of the hinge doors 80 and 81. The dispenser 90 allows the user to retrieve water or ice stored in the refrigerating compartment 50 from the outside of the refrigerator without opening the doors 80 and 81.

An ice making chamber 70 is provided at one corner portion of an upper portion of the refrigerating compartment 50, to produce ice. Although in FIG. 1, the ice making chamber is shown in one corner of the refrigerating compartment, as a non-limiting example, the ice making chamber may be provided in any other corners of the refrigerating compartment. Further, the ice making chamber may be provided in any corner of the freezing compartment. Although not shown, an ice making tray to store water and thus to produce ice therein, may be disposed in the ice making chamber 70. Also, an ejector to release ice produced in the ice making tray may be disposed in the ice making chamber 70. An ice bucket 200 (FIG. 6) to store ice released from the ice making tray and a feeder to feed ice stored in the ice bucket 200 may also be disposed in the ice making chamber 70.

In particular, the ice making chamber 70 of the refrigerator according to the illustrated embodiment of the present disclosure is formed in a space defined between the inner case 20 and the ice making chamber case 100 under the condition that the ice making chamber case 100 is coupled to the inside of the inner case 20. A reinforcing member 93 may be coupled to the top of the inner case 20, to enhance the coupling strength of the ice making chamber case 100. A sealing member 92 may be interposed between coupling portions of the inner case 20 and ice making chamber case 100, to seal the inner case 20 and ice making chamber case 100.

A detailed assembly structure of the ice making chamber 70 will be described later.

The cold air supplier includes a compressor (not shown) to compress a refrigerant, a condenser (not shown) to condense the refrigerant from a vapor phase into a liquid phase, an expansion device (not shown) to expand the refrigerant, an evaporator (not shown) to evaporate the refrigerant from the liquid phase into the vapor phase in order to generate cold air while absorbing heat, a refrigerant tube (not shown) to guide the refrigerant, and a blowing fan (not shown) to force the cold air to flow.

Figure 3:
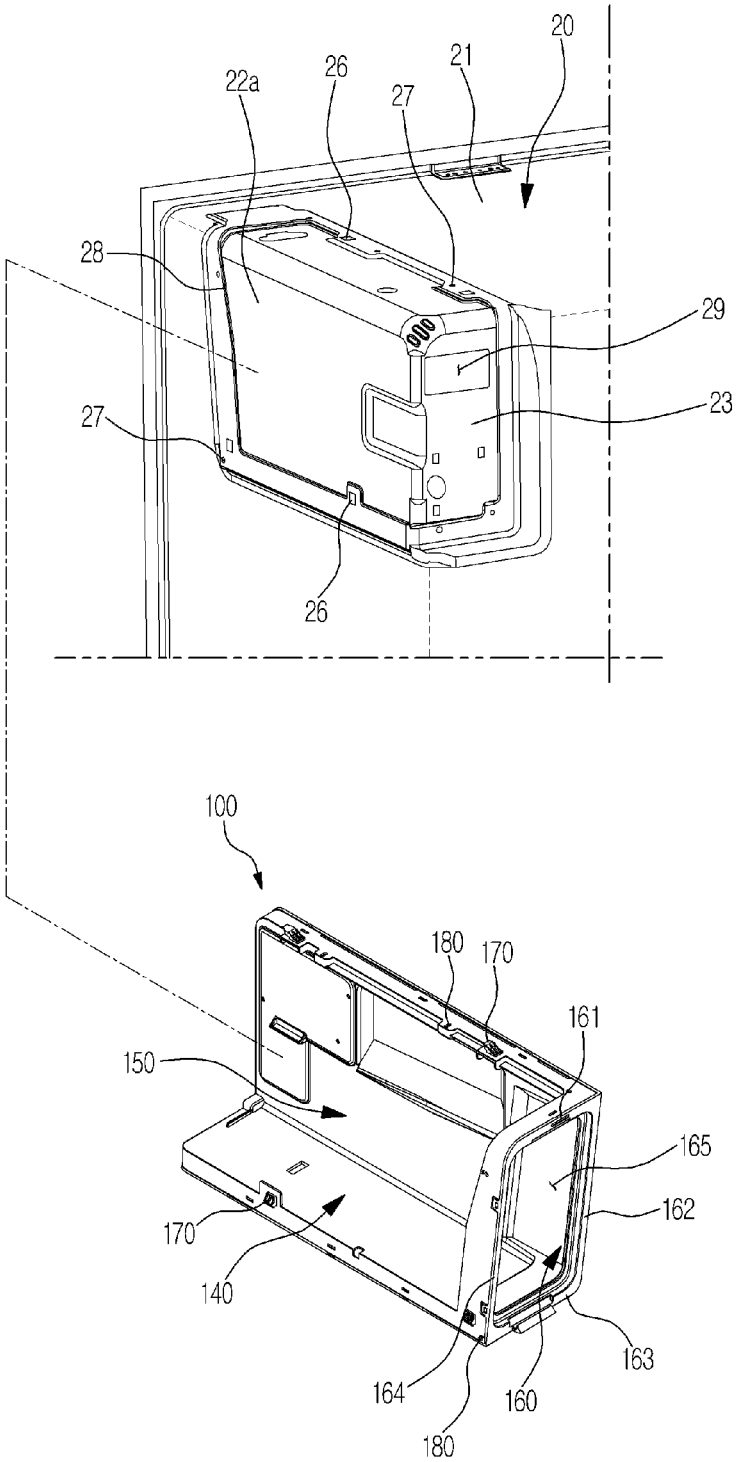
FIG. 3 is an exploded perspective view illustrating an assembly structure of an ice making chamber of the refrigerator shown in FIG. 1.
Figure 4:
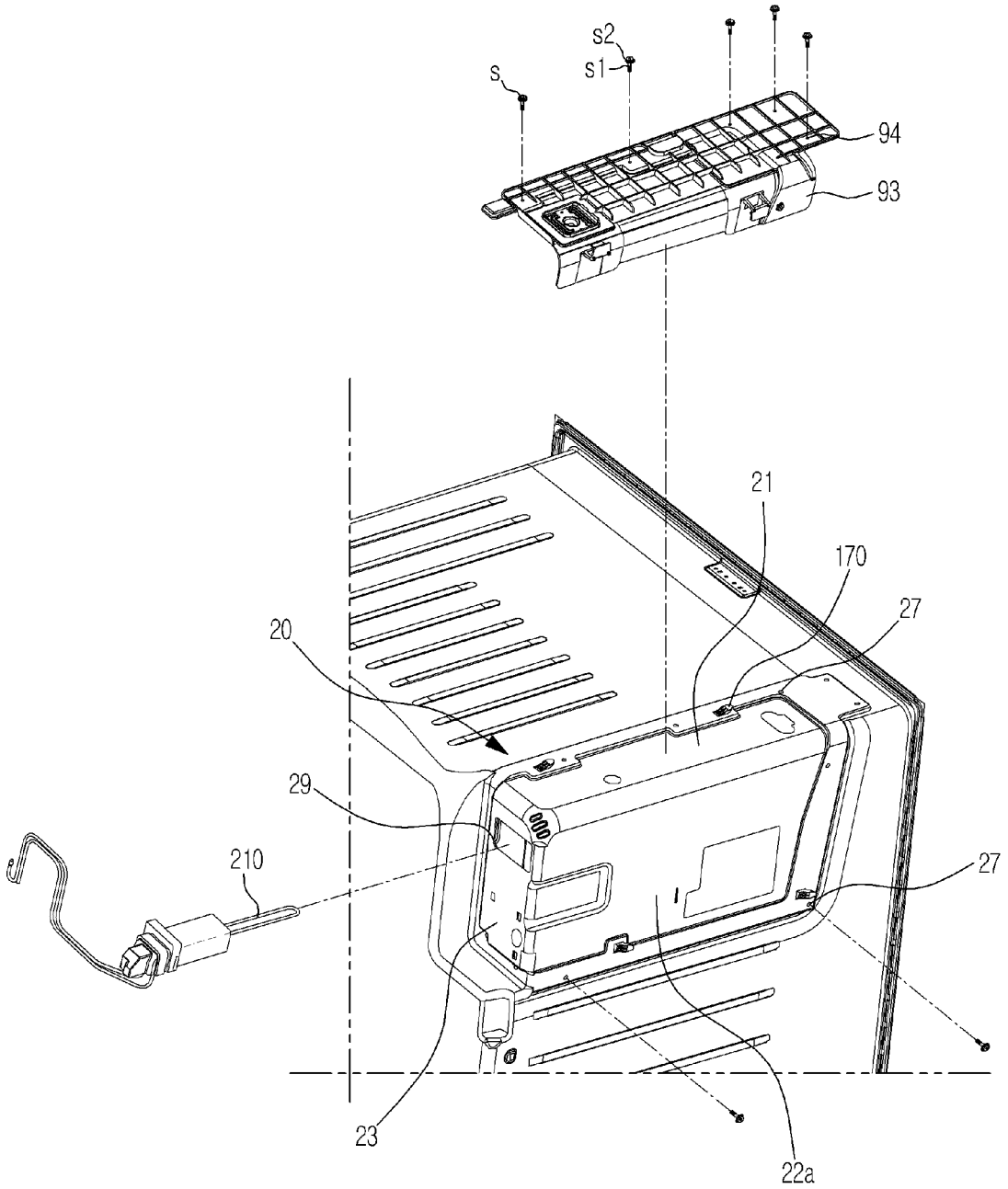
FIG. 4 is an exploded perspective view taken in a direction different from that of FIG. 3, illustrating the assembly structure of the ice making chamber of the refrigerator shown in FIG. 1.
Figure 5:
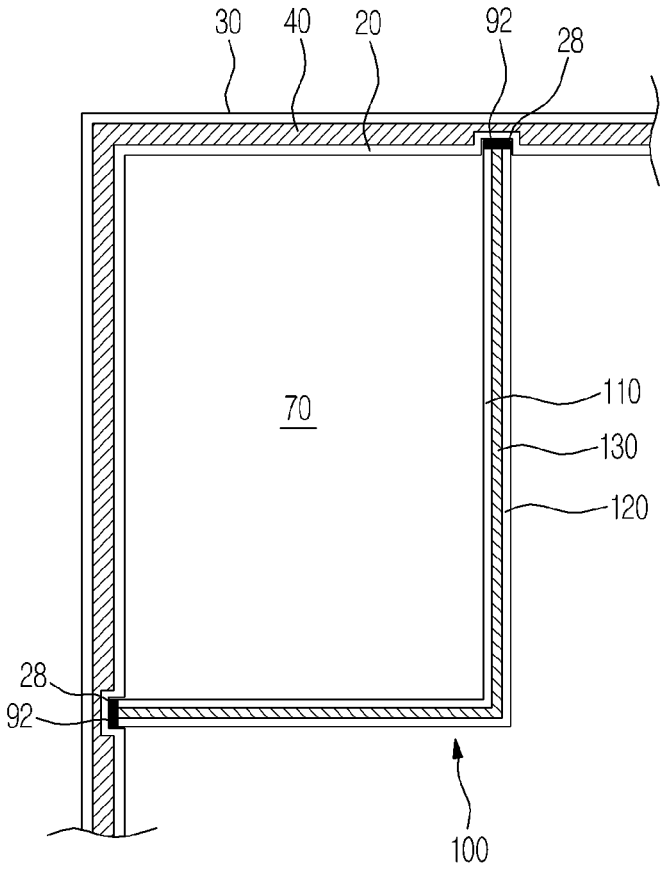
FIG. 5 is a cross-sectional view taken along the line I-I of FIG. 1.
Figure 6:
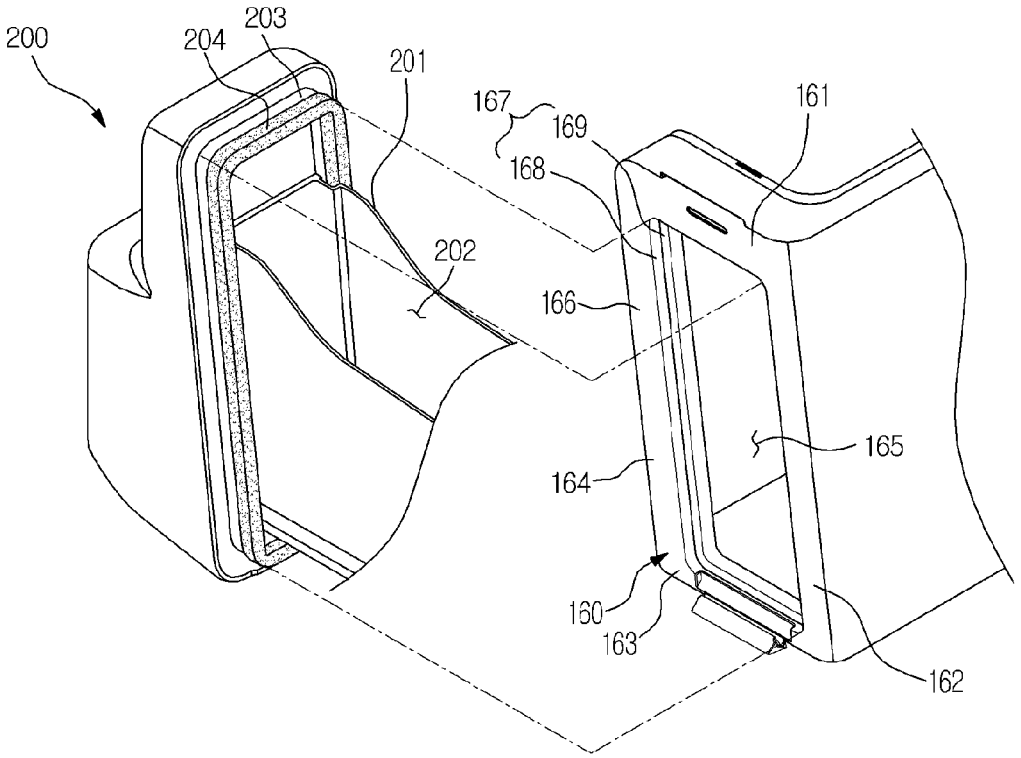
FIG. 6 is an exploded perspective view illustrating a structure of a front edge of the ice making chamber case in the refrigerator shown in FIG. 1.
Figure 7:
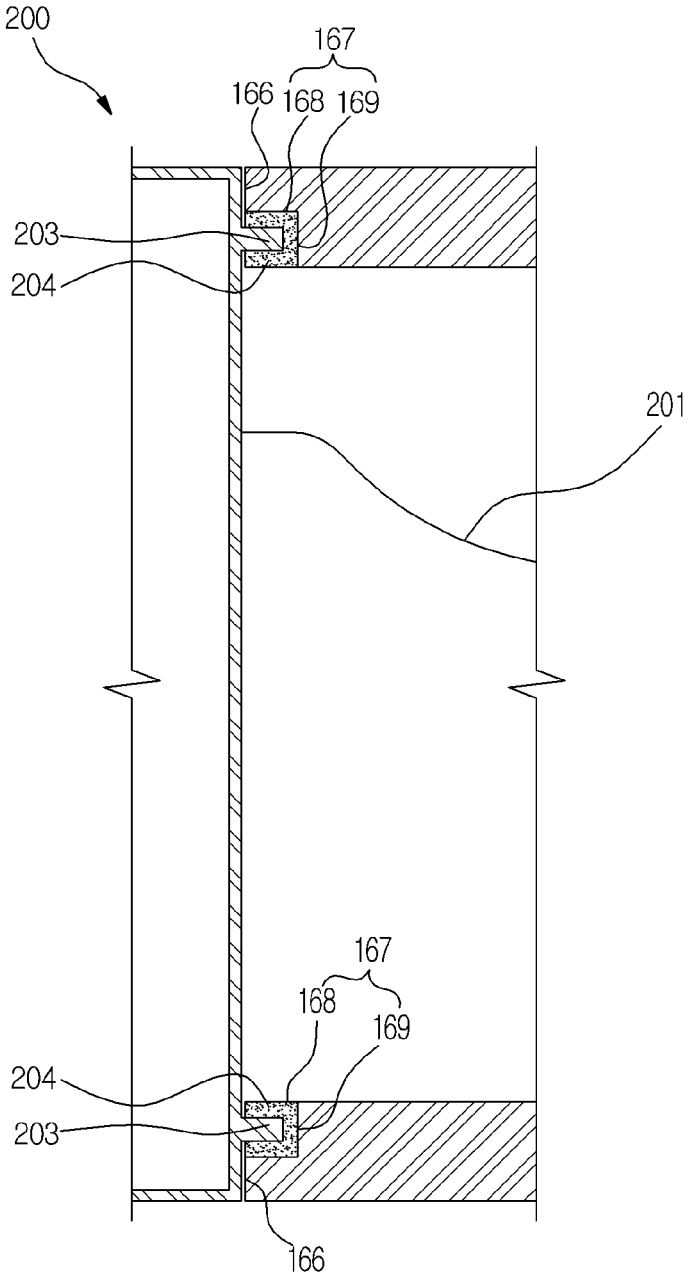
FIG. 7 is a sectional view illustrating the structure of the front edge of the ice making chamber case in the refrigerator shown in FIG. 1.

FIG. 3 is an exploded perspective view illustrating an assembly structure of the ice making chamber of the refrigerator shown in FIG. 1. FIG. 4 is an exploded perspective view taken in a direction different from that of FIG. 3, illustrating the assembly structure of the ice making chamber of the refrigerator shown in FIG. 1. FIG. 5 is a cross-sectional view taken along the line I-I of FIG. 1. FIG. 6 is an exploded perspective view illustrating a structure of a front edge of the ice making chamber case in the refrigerator shown in FIG. 1. FIG. 7 is a sectional view illustrating the structure of the front edge of the ice making chamber case in the refrigerator shown in FIG. 1.

Hereinafter, the assembly structure of the ice making chamber 70 according to the illustrated embodiment of the present disclosure will be described with reference to FIGS. 3 to 7.

The ice making chamber case 100 includes a horizontal wall 140, a vertical wall 150, a front opening 165, and a front edge 160. Each of the horizontal wall 140, vertical wall 150 and front edge 160 includes the case insulator 130 (FIG. 5) in order to insulate the ice making chamber 70.

Although the horizontal wall 140 and vertical wall 150 are substantially perpendicular to each other in the illustrated case, embodiments of the present disclosure are not limited thereto. Also, although the horizontal wall 140 extends horizontally in parallel with the top wall 21 of the inner case 20, and the vertical wall 150 extends vertically in parallel with the side walls 22*a* and 22*b* of the inner case 20 in the illustrated case, embodiments of the present disclosure are not limited thereto.

When the ice making chamber case 100 is coupled to the inside of the inner case 20, the horizontal wall 140 and vertical wall 150 may form the ice making chamber 70, together with at least a portion of the top wall 21 of the inner case 20, at least a portion of one side wall 22*a* of the inner case 20, and at least a portion of the rear wall 23 of the inner case 20.

As shown in FIG. 6, an ice storage box 201 of the ice bucket 200 may be slidably inserted into the ice making chamber 70 through the front opening 165. The ice storage box 201 has an ice storage space 202 to store ice therein.

The front edge 160 not only functions as a stopper to limit the insertion distance of the ice bucket 200 into the ice making chamber 70, but also supports the ice bucket 200 in a state in which the ice bucket 200 is completely inserted into the ice making chamber 70.

The front edge 160 includes a first edge portion 161 to contact the top wall 21 of the inner case 20, a second edge portion 162 to form a portion of the vertical wall 150 in the ice making chamber case 100, a third edge portion 163 to form a portion of the horizontal wall 140 in the ice making chamber case 100, and a fourth edge portion 164 to contact one side wall 22*a* of the inner case 20. The front opening 165 is formed by inner surfaces of the first edge portion 161, second edge portion 162, third edge portion 163, and fourth edge portion 164.

The front edge 160 also includes a gasket contact portion 167 to seal the ice bucket 200 and ice making chamber 70. A gasket 204 installed at the ice bucket 200 may contact the gasket contact portion 167 in a dual surface contact manner.

The ice bucket 200 includes a gasket fitting portion 203 protruded rearwards from the ice bucket 200. Accordingly, the gasket 204 may be installed at the gasket fitting portion 203 in a state of being fitted around an end of the gasket fitting portion 203.

The gasket contact portion 167 of the front edge 160 is formed to be inwardly recessed from an outer surface 166 of the front edge 160. The gasket contact portion 167 may include a first surface 168 inwardly inclined from the outer surface 166, and a second surface 169 inclined from the first surface 168 such that a step is formed between the outer surface 166 and the second surface 169. The outer surface 166 and second surface 169 may extend substantially horizontally.

When the ice bucket 200 is inserted into the ice making chamber 70, the gasket 204 of the ice bucket 200 comes into contact with the gasket contact portion 167 in a dual surface contact manner. That is, the gasket 204 comes into contact with the first and second surfaces 168 and 169 of the gasket contact portion 167. Thus, the gasket 204 may tightly seal the ice making chamber 70.

Meanwhile, the ice making chamber case 100 may be coupled to the inside of the inner case 20, using an engagement structure including an engagement protrusion 170 and an engagement hole 26, and a fastening structure including fastening members S.

In detail, one or more engagement holes 26 may be formed at the inner case 20. Also, one or more engagement protrusions 170 may be formed at the ice making chamber case 100 at positions corresponding to respective engagement holes 26. In accordance with engagement of the engagement protrusions 170 in the engagement holes 26, the ice making chamber case 100 may be kept in position within the inner case 20.

The engagement between the engagement holes 26 and the engagement protrusions 170 is relatively weak. Accordingly, it may be possible to disengage the engagement protrusions 170 from the engagement holes 26 by applying a certain disengagement force to the engagement protrusions 170 engaged in the engagement holes 26. In this regard, the ice making chamber case 100 may be temporarily fixed to the inside of the inner case 20 through engagement of the engagement protrusions 170 in the engagement holes 26.

One or more first fastening holes 27 and one or more second fastening holes 180 may be formed at the inner case 20 and ice making chamber case 100, respectively, to fasten the ice making chamber case 100 to the inner case 20.

Each first fastening hole 27 of the inner case 20 may have a structure extending through the inner case 20. On the other hand, each second fastening hole 180 may have a structure extending through the ice making chamber case 100 or a structure extending into the ice making chamber case 100 without extending through the ice making chamber case 100. In the refrigerator 1 according to the illustrated embodiment, each second fastening hole 180 may have a groove structure in order to prevent a fastening member S inserted into the second fastening hole 180 from being outwardly exposed.

It may be possible to firmly lock the ice making chamber case 100 at the inside of the inner case 20 by temporarily fixing the ice making chamber case 100 to the inside of the inner case 20 by the engagement holes 26 and engagement protrusions 170, and then fastening the fastening members S into the first and second fastening holes 27 and 180.

As for the fastening members S, screws, rivets or bolts may be used. However, the fastening members S are not limited to such members. Each fastening member S may include a fastening portion S1 (FIG. 4) to be inserted into the corresponding first and second fastening holes 27 and 180, and a head S2 (FIG. 4) formed at one end of the fastening portion S1. Threads may be formed at an outer peripheral surface of the fastening portion S1.

In the refrigerator according to the illustrated embodiment of the present disclosure, each fastening member S may be fastened into the first and second fastening holes 27 and 180 in an inward direction from the outside of the inner case 20. Accordingly, the head S2 of each fastening member S may be disposed at the outside of the inner case 20, in particular, between the inner case 20 and the outer case 30. Thus, the head S2 of each fastening member S may be covered by the body insulator 40 which is foamed between the inner case 20 and the outer case 30. In this regard, the head S2 of each fastening member S may not degrade the esthetics of the refrigerator 1 because it is not outwardly exposed.

Grooves 28 (FIG. 5) may be formed at portions of the inner case 20 contacting ends of the ice making chamber case 100, to receive the ends of the ice making chamber case 100. As the ends of the ice making chamber case 100 are inserted into the grooves 28, the area of the ice making chamber case 100 contacting the inner case 20 is increased. Thus, it may be possible to minimize a phenomenon in which cold air flows between the ice making chamber case 100 and the inner case 20.

In order to more tightly seal the inner case 20 and ice making chamber case 100, a sealing member 92 such as a sponge may be interposed between the inner case 20 and the ice making chamber case 100.

A reinforcing member 93 may be coupled to the top of the inner case 20 in order to increase the coupling strength of the ice making chamber case 100. The reinforcing member 93 may have a plate structure such that it may closely contact the top of the inner case 20. The reinforcing member 93 may be formed with one or more third fastening holes 94 at positions corresponding to the first and second fastening holes 27 and 180 of the inner case 20 and ice making chamber case 100.

Accordingly, the ice making chamber case 100, inner case 20 and reinforcing member 93 may be locked together in accordance with fastening of the fastening members S into the first fastening holes 27, second fastening holes 180 and third fastening holes 94.

Figure 8:
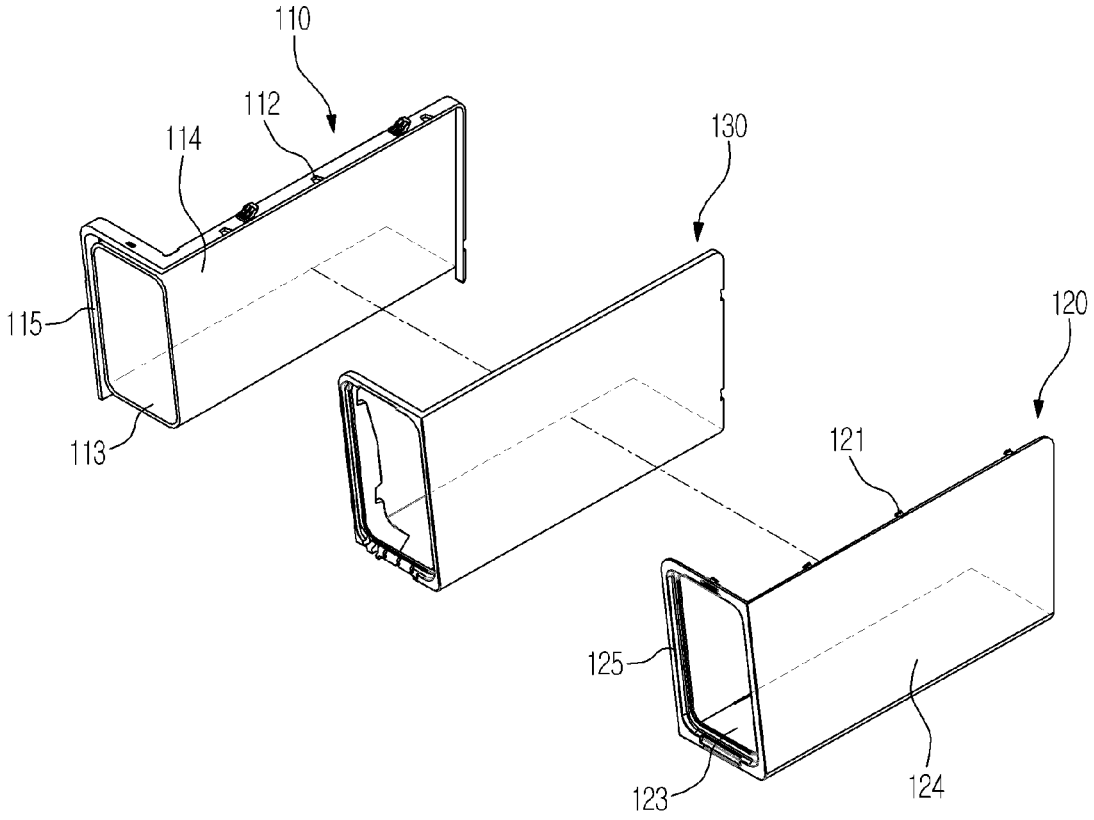
FIG. 8 is an exploded perspective view illustrating the ice making chamber case of the refrigerator shown in FIG. 1.

FIG. 8 is an exploded perspective view illustrating the ice making chamber case of the refrigerator shown in FIG. 1. A configuration of the ice making chamber case 100 according to an embodiment of the present disclosure will be further described with reference to FIG. 8.

The ice making chamber case 100 according to the illustrated embodiment of the present disclosure may include a first ice making chamber case 110, a second ice making chamber case 120 and a case insulator 130.

The first ice making chamber case 110 may include a first horizontal wall 113, a first vertical wall 114, and a first front edge 115. The second ice making chamber case 120 may include a second horizontal wall 123, a second vertical wall 124, and a second front edge 125.

The first ice making chamber case 110 forms an inner case of the ice making chamber 70. The second ice making chamber case 120 is coupled to the outside of the first ice making chamber case 110. The second ice making chamber case 120 forms an outer case of the ice making chamber 70.

The first ice making chamber case 110 and second ice making chamber case 120 may be coupled through various coupling structures. For example, a fitting structure using protrusions and grooves may be used to couple the first ice making chamber case 110 and second ice making chamber case 120.

One or more fitting holes 112 are formed at the first ice making chamber case 110. One or more fitting protrusions 121 may be formed at the second ice making chamber case 120 at positions corresponding to the fitting holes 112. Accordingly, the first and second ice making chamber cases 110 and 120 may be coupled through fitting of the fitting protrusions 121 into the fitting holes 112.

Similar to the body insulator 40, the case insulator 130 may be formed by coupling the inner and outer ice making chamber cases 110 and 120, filling a space between the coupled inner and outer ice making chamber cases 110 and 120 with a liquid foaming agent such as urethane, and expanding the foaming agent.

Since the case insulator 130 has a relatively simple shape, it may be possible to separately prepare the case insulator 130 and then to couple the case insulator 130 between the first and second ice making chamber cases 110 and 120 upon coupling the first and second ice making chamber cases 110 and 120.

Figure 9:
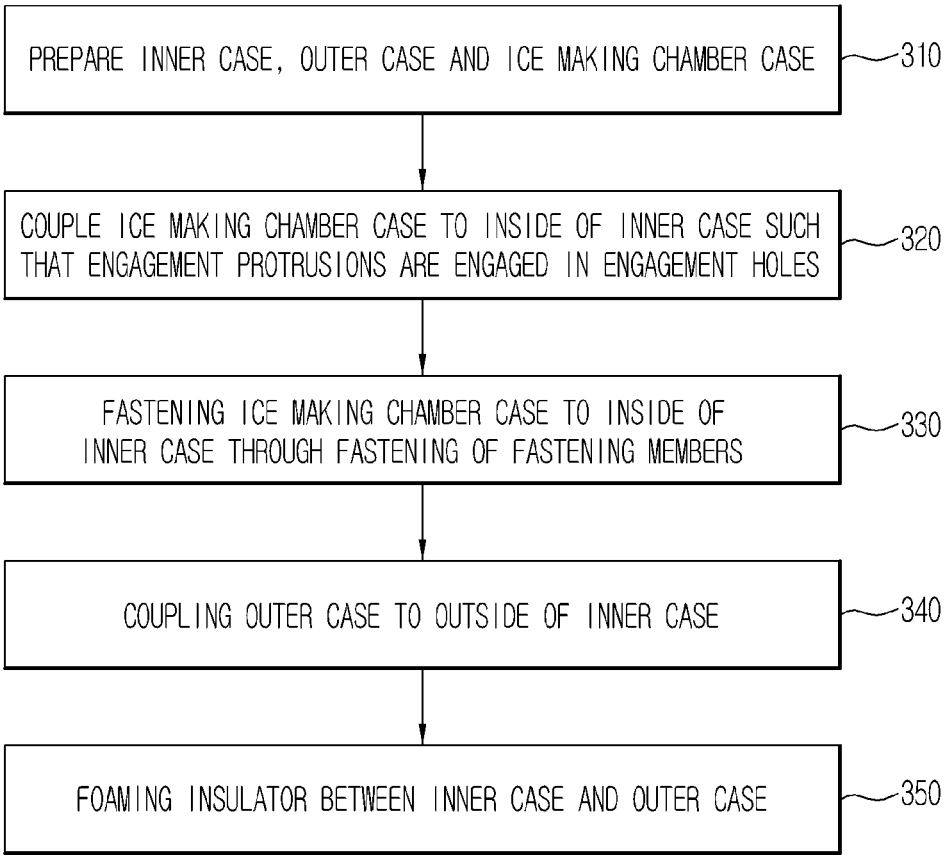
FIG. 9 is a flowchart illustrating a method of manufacturing the refrigerator in accordance with an embodiment of the present disclosure.

FIG. 9 is a flowchart illustrating a method of manufacturing the refrigerator in accordance with an embodiment of the present disclosure. Hereinafter, the refrigerator manufacturing method according to the illustrated embodiment will be described in brief with reference to FIGS. 1 to 9.

First, the inner case 20, outer case 30 and ice making chamber case 100 are prepared (310).

The inner case 20 may be injection-molded to have an integrated structure with the engagement holes 26 and first fastening holes 27 for coupling of the inner case 20 to the ice making chamber case 100.

The ice making chamber case 100 may be formed by coupling the first and second ice making chamber cases 110 and 120, and foaming the case insulator 130 between the first and second ice making chamber cases 110 and 120. Alternatively, the ice making chamber case 100 may be formed by preparing the case insulator 130, and then coupling the case insulator 130 between the first and second ice making chamber cases 110 and 120 upon coupling the first and second ice making chamber cases 110 and 120. Also, the engagement protrusions 170 and second fastening holes 180 are provided at the ice making chamber case 100.

Thereafter, the ice making chamber case 100 is coupled to the inside of the inner case 20 such that the engagement protrusions 170 are engaged in the engagement holes 26 (320). In this case, the sealing member 92 may be interposed between the inner case 20 and the ice making chamber case 100, to seal the inner case 20 and ice making chamber case 100.

Subsequently, the fastening members S are fastened into the first and second fastening holes 27 and 180 (330). In this case, the fastening member S are fastened into the first and second fastening holes 27 and 180 in an inward direction from the outside of the inner case 20 and, as such, the head S2 of each fastening member S is disposed between the inner case 20 and the outer case 30. In this case, the reinforcing member 93 may also be coupled to the outside of the inner case 20, to enhance the coupling strength of the ice making chamber case 100.

The outer case 30 is then coupled to the outside of the inner case 20 (340).

Thereafter, the body insulator 40 is foamed between the inner case 20 and the outer case 30 (350). The body insulator 40 may be formed by coupling the inner and outer cases 20 and 30, filling a space between the coupled inner and outer cases 20 and 30 with a liquid foaming agent such as urethane, and expanding the foaming agent.

In accordance with the above-described method, it may be possible to firmly fasten the ice making chamber case 100 to the inside of the inner case 20 and thus to tightly seal the ice making chamber case 100 and inner case 20 in the procedure of forming the ice making chamber 70 through assembly of the ice making chamber case 100 to the inside of the inner case 20. Since the fastening members S or the like are not outwardly exposed, it may be possible to enhance the appearance of the refrigerator 1. Also, the inner case 20 may have a simple shape. Since insulator foaming in the wall space of the ice making chamber case 100 and insulator foaming in the wall space of the body 10, the space between the inner case 20 and the outer case 30, are separately carried out, it may be possible to prevent leakage of a liquid foaming agent and deformation of the inner case 20. It may be possible to prepare the ice making chamber case 100 separately from molding of the inner case 20.

Figure 10:
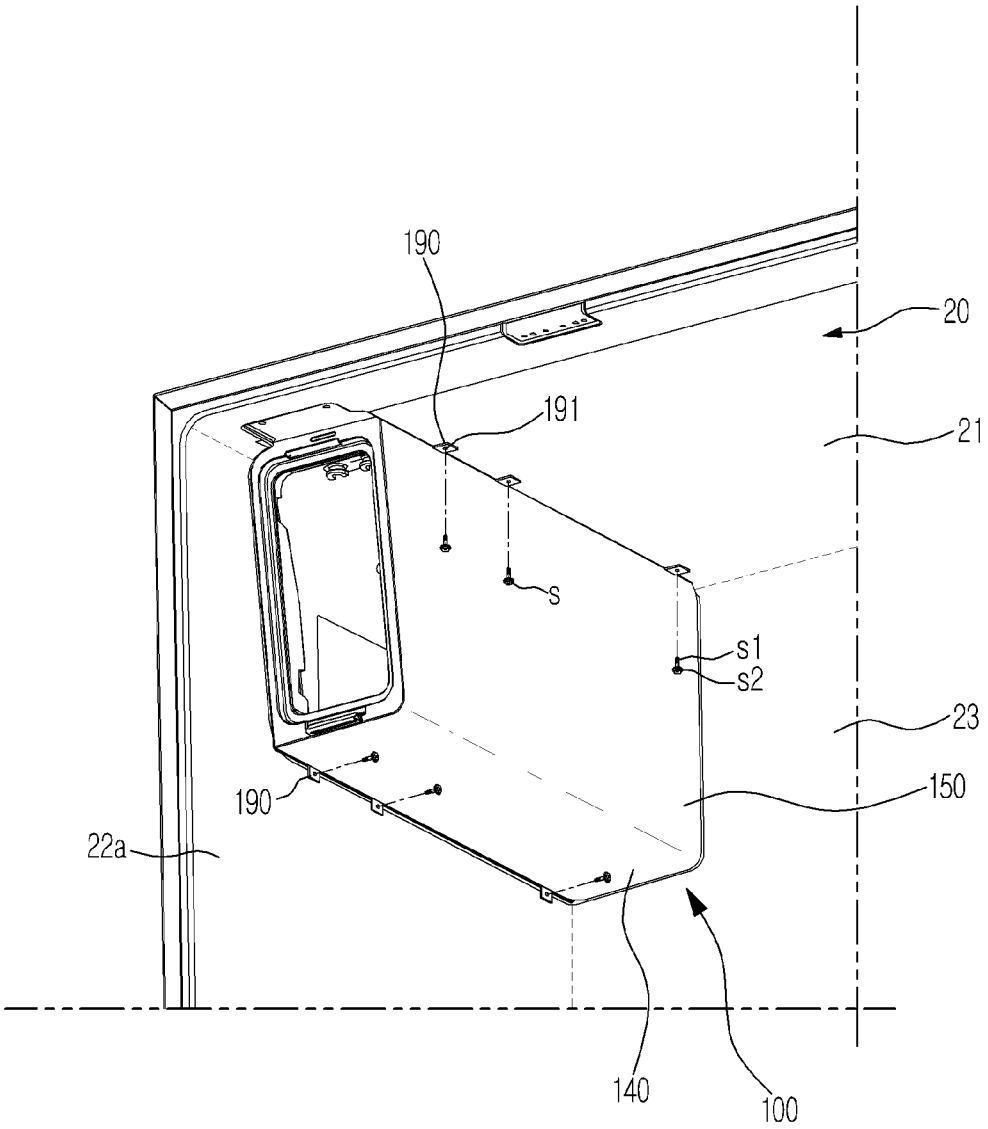
FIG. 10 is a view illustrating an ice making chamber assembly structure of a refrigerator according to another embodiment of the present disclosure.
Figure 11:
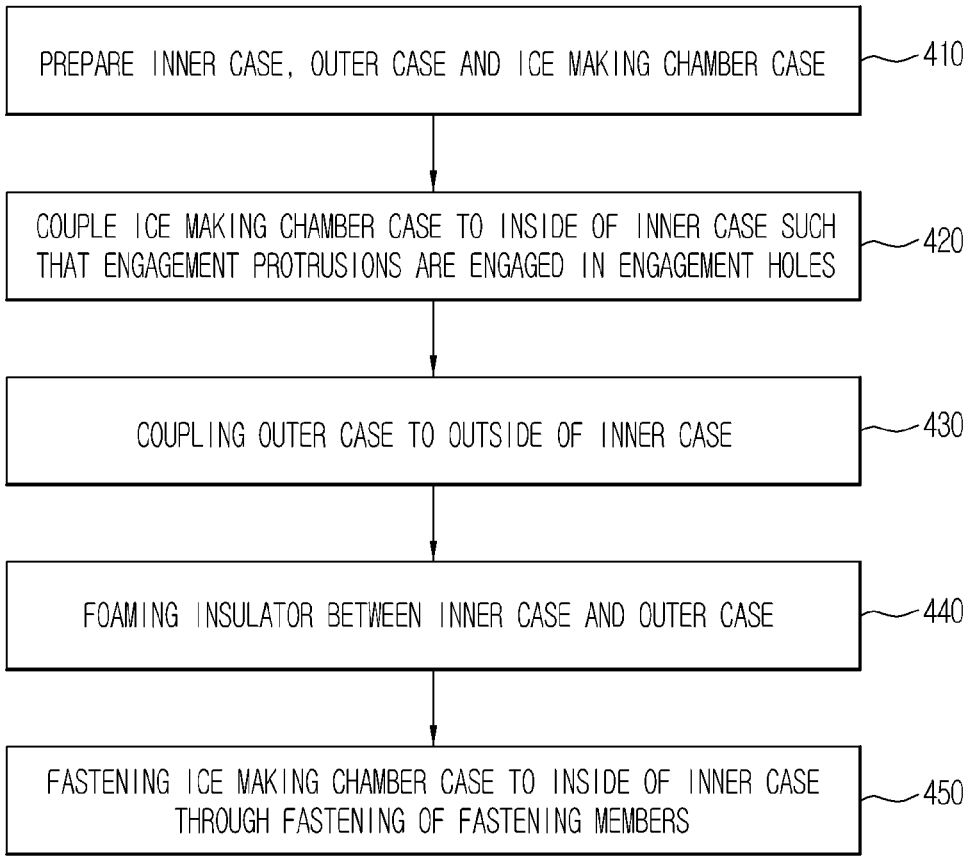
FIG. 11 is a flowchart illustrating a method of manufacturing the refrigerator according to the embodiment of FIG. 10.

FIG. 10 is a view illustrating an ice making chamber assembly structure of a refrigerator according to another embodiment of the present disclosure. FIG. 11 is a flowchart illustrating a method of manufacturing the refrigerator according to the embodiment of FIG. 10.

Hereinafter, the structure of the refrigerator according to the embodiment of FIG. 10 and a manufacturing method thereof will be described with reference to FIGS. 10 and 11. The same constituent components as those of the previous embodiment will be designated by the same reference numerals, and descriptions thereof may be omitted.

The ice making chamber case 10 in the refrigerator according to the embodiment of FIG. 10 includes one or more coupling protrusions 190 outwardly protruded from each of the horizontal wall 140 and vertical wall 150. Each coupling protrusion 190 may be formed with a second fastening hole 191 at a position corresponding to a corresponding one of the first fastening holes (not shown) in the inner case 20.

In order to fix the ice making chamber case 100 to the inside of the inner case 20, fastening members S are fastened into the first fastening holes (not shown) and second fastening holes 191 in an outward direction from the inside of the inner case 20. Accordingly, the heads S2 of the fastening members S may be exposed to the inside of the inner case 20. Although not shown, a screw cap may cover the exposed head S2 of each fastening member S.

As shown in FIG. 11, the method of manufacturing the refrigerator according to the embodiment of FIG. 10 is carried out as follows. First, the inner case 20, outer case 20 and ice making chamber case 100 are prepared (410). Thereafter, the ice making chamber case 100 is coupled to the inside of the inner case 20 such that the engagement protrusions 170 are engaged in the engagement holes 26 (420). The outer case 30 is coupled to the outside of the inner case 20 (430). The body insulator 40 is then foamed between the inner case 20 and the outer case 40 (440). The body insulator 40 may be formed by coupling the inner and outer cases 20 and 30, filling a space between the coupled inner and outer cases 20 and 30 with a liquid foaming agent such as urethane, and expanding the foaming agent.

Subsequently, the fastening members S are fastened into the first and second fastening holes 27 and 191 and, as such, the ice making chamber case 100 is fixed to the inside of the inner case 20 (450). In this case, the fastening members S are fastened in an outward direction from the inside of the inner case 20. Fastening of the fastening members S in an outward direction from the inside of the inner case 20 as described above is possible because the second fastening holes 191 are formed through the coupling protrusions 190 protruded from the horizontal wall 140 and vertical wall 150 of the ice making chamber case 100.

In accordance with the assembly structure of the ice making chamber 70 in the refrigerator according to the embodiment of FIG. 10, it may be possible to separate the ice making chamber case 100 from the inner case 20. That is, since the heads S2 of the fastening members S are outwardly exposed, it may be possible to unfasten the fastening members S from the first fastening holes 27 and second fastening holes 191. Then, it may be possible to separate the ice making chamber case 100 from the inner case 20 by disengaging the engagement protrusions 170 from the engagement holes 26 by slight physical force.

Thus, the user may easily access the interior of the ice making chamber 70 after separating the ice making chamber case 100 when replacement or repair of components installed in the ice making chamber 70 is required.

Differently than conventional refrigerators in which the ice making chamber is integrated with the inner case, the ice making chamber in the refrigerator according to any one of the embodiments of the present disclosure is formed by a portion of the inner case and the ice making chamber case coupled to the inside of the inner case. Accordingly, it may be possible to simplify the shape of the inner case. It may also be possible to prepare the ice making chamber case before molding of the inner case.

When the ice making chamber case has a modular structure, it may be possible to apply the modular ice making chamber case to various refrigerators.

In the refrigerator according to any one of the embodiments of the present disclosure, insulator foaming in the body and insulator foaming in the ice making chamber wall are separately carried out, differently than conventional refrigerators in which insulator foaming in the body and insulator foaming in the ice making chamber wall are simultaneously carried out. Accordingly, it may be possible to prevent leakage of a liquid foaming agent and deformation of the inner case.

Differently than conventional refrigerators in which separate of the ice making chamber wall is impossible, the ice making chamber case in the refrigerator according to any one of the embodiments of the present disclosure may be separable from the inner case. Accordingly, it may be possible to easily achieve replacement and repair of components installed in the ice making chamber.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

an inner case comprising a plurality of grooves protruding inward toward an outer case and a storage compartment formed in an inside of the inner case, the storage compartment being partitioned into a refrigerating compartment and a freezing compartment;

the outer case coupled to an outside of the inner case;

a body insulator interposed between the inner case and the outer case; and an ice making chamber case detachably coupled to the inside of the inner case, which is in the refrigerating compartment or the freezing compartment, the ice making chamber case forming an ice making chamber together with at least a portion of the inner case, wherein the ice making chamber case comprises:

a first ice making chamber case comprising a first horizontal wall and a first vertical wall, a second ice making chamber case coupled to an outside of the first ice making chamber case, the second ice making chamber case comprising a second horizontal wall and a second vertical wall, and a case insulator interposed between the first ice making chamber case and the second ice making chamber case, to insulate the ice making chamber, the case insulator being separate from the body insulator, the case insulator and the body insulator being formed separately, wherein an end of at least one of a plurality of sides of the ice making chamber case including the first ice making chamber case, the second ice making chamber case, and the case insulator is insertable in one of the plurality of grooves of the inner case, and wherein the case insulator and the body insulator are arranged spaced apart from each other to sandwich at least a portion of the inner case.

2. The refrigerator according to claim 1, wherein:

the inner case further comprises a top wall, opposite side walls, a rear wall, a bottom wall, and an intermediate wall; and the ice making chamber is formed by at least a portion of the top wall, at least a portion of one of the side walls, and at least a portion of the rear wall, the first horizontal wall and the first vertical wall.

3. The refrigerator according to claim 1, wherein:

the ice making chamber case further comprises a front opening, and a front edge formed along an outside of the front opening; and the front edge comprises the case insulator.

4. The refrigerator according to claim 1, wherein:

the inner case further comprises one or more engagement holes and one or more first fastening holes;

the ice making chamber case further comprises one or more engagement protrusions respectively formed at positions corresponding to the one or more engagement holes, and one or more second fastening holes formed at positions corresponding to the one or more first fastening holes;

the engagement protrusions are engaged in the one or more engagement holes, respectively; and fastening members are fastened into corresponding ones of the one or more first and second fastening holes, respectively.

5. The refrigerator according to claim 1, further comprising:

a sealing member in at least one of the plurality of grooves interposed between the inner case and the ice making chamber case, to seal the ice making chamber case from the inner case.

6. The refrigerator according to claim 5, wherein the sealing member comprises a sponge.

7. The refrigerator according to claim 1, further comprising:

a reinforcing member coupled to the outside of the inner case.

8. A refrigerator comprising:

an inner case comprising a plurality of grooves protruding inward toward an outer case, a top wall, opposite side walls, a rear wall and a bottom wall;

the outer case coupled to an outside of the inner case;

a body insulator interposed between the inner case and the outer case;

an ice making chamber case detachably coupled to an inside of the inner case, to form an ice making chamber, the ice making chamber case comprising a horizontal wall, a vertical wall, a front opening and a front edge formed along an outside of the front opening; and an ice bucket slidable into the ice making chamber through the front opening, wherein the front edge comprises:

a first edge contacting the top wall, a second edge to form at least a portion of the vertical wall, a third edge to form at least a portion of the horizontal wall, and a fourth edge contacting one of the side walls, wherein each of the horizontal wall, the vertical wall, and the front edge comprises a case insulator, the case insulator being separate from the body insulator, the case insulator and body insulator being formed separately, wherein an end of at least one of a plurality of sides of the ice making chamber case including the case insulator is insertable in one of the plurality of grooves of the inner case, and wherein the case insulator and body insulator are arranged spaced apart from each other to sandwich at least a portion of the inner case.

9. The refrigerator according to claim 8, wherein:

the ice bucket comprises a gasket to seal the ice making chamber;

the front edge further comprises an outer surface, and a gasket contact portion extending inwardly from the outer surface, to enable the gasket to contact the gasket contact portion;

the gasket contact portion comprises a first surface inwardly inclined from the outer surface, and a second surface inclined from the first surface, such that a step is formed between the outer surface and the second surface; and the gasket contacts the first and second surfaces in a dual surface contact manner.

10. A refrigerator comprising:

an inner case comprising a plurality of grooves protruding inward toward an outer case, a top wall, opposite side walls, a rear wall and a bottom wall;

the outer case coupled to an outside of the inner case;

a body insulator interposed between the inner case and the outer case;

an ice making chamber case detachably coupled to an inside of the inner case, the ice making chamber case comprising a horizontal wall and a vertical wall, and the ice making chamber case being coupled to the inside of the inner case such that the horizontal and vertical walls form an ice making chamber together with at least a portion of the top wall, at least a portion of one of the side walls, and at least a portion of the rear wall, wherein the inner case further comprises one or more engagement holes and one or more first fastening holes, wherein the ice making chamber case further comprises one or more engagement protrusions respectively formed at positions corresponding to the one or more engagement holes, and one or more second fastening holes formed at positions corresponding to the one or more first fastening holes;

wherein the one or more engagement protrusions are engaged in the one or more engagement holes, respectively, wherein fastening members are fastened into corresponding ones of the one or more first fastening holes and the one or more second fastening holes, respectively, wherein each of the horizontal wall and the vertical wall comprises a case insulator, the case insulator being separate from the body insulator, the case insulator and the body insulator being formed separately, wherein an end of at least one of a plurality of sides of the ice making chamber case including the case insulator is insertable in one of the plurality of grooves of the inner case, and wherein the case insulator and the body insulator are arranged spaced apart from each other to sandwich at least a portion of the inner case.

11. The refrigerator according to claim 10, wherein:

each of the fastening members comprises a fastening portion to be fastened into the corresponding one or more first fastening holes and the one or more second fastening holes, and a head formed at one end of the fastening portion; and the head is disposed between the inner case and the outer case while being covered by the body insulator.

12. The refrigerator according to claim 10, wherein each of the fastening members comprises a fastening portion to be fastened into the corresponding one or more first fastening holes and the one or more second fastening holes, and a head formed at one end of the fastening portion; and the head is disposed at the inside of the inner case.

13. The refrigerator according to claim 12, wherein:

the ice making chamber case further comprises:

one or more fitting protrusions protruded from each of the horizontal and vertical walls; and one or more second fitting holes that are formed at the one or more fitting protrusions, respectively.

14. The refrigerator according to claim 10, further comprising:

a reinforcing member coupled to the outside of the inner case, wherein the reinforcing member comprises one or more third fitting holes respectively formed at positions corresponding to corresponding ones of the one or more first fastening holes and the one or more second fastening holes, wherein each of the fastening members is fastened into corresponding ones of the one or more first fastening holes, the one or more second fastening holes, and the one or more third fastening holes.

* * * * *